US005711367A

United States Patent [19]

Lauener

[11] Patent Number: 5,711,367

[45] Date of Patent: Jan. 27, 1998

[54] APPARATUS FOR DELIVERING MOLTEN METAL TO A CASTER INCLUDING WEAR STRIPS

[75] Inventor: Wilhelm F. Lauener, Gerlafingen/SO, Switzerland

[73] Assignee: Larex A.G., Recherswil Solothurn, Switzerland

[21] Appl. No.: 567,179

[22] Filed: Jan. 11, 1996

[51] Int. Cl.[6] ..... B22D 41/50

[52] U.S. Cl. ..... 164/432; 164/437; 222/591; 222/606

[58] Field of Search ..... 164/431, 432, 164/437, 438, 439, 440; 222/591, 606, 607

[56] References Cited

U.S. PATENT DOCUMENTS

| | | |
|---|---|---|
| 3,774,670 | 11/1973 | Gyongyos . |
| 4,290,477 | 9/1981 | Huber et al. . |
| 4,485,835 | 12/1984 | Huber et al. . |
| 4,550,766 | 11/1985 | Ai et al. . |
| 4,550,767 | 11/1985 | Yu et al. . |
| 4,619,309 | 10/1986 | Huber et al. . |
| 4,785,873 | 11/1988 | Lauener . |
| 4,794,978 | 1/1989 | Lauener . |
| 4,798,315 | 1/1989 | Lauener . |
| 4,964,456 | 10/1990 | Lauener . |

FOREIGN PATENT DOCUMENTS

| | | | |
|---|---|---|---|
| 864035 | 6/1978 | Belgium . | |
| 0073573 | 3/1983 | European Pat. Off. | 222/606 |
| 1-237053 | 9/1989 | Japan | 164/437 |
| 1-273654 | 11/1989 | Japan | 164/437 |
| 1-289545 | 11/1989 | Japan | 164/437 |
| 4-37446 | 2/1992 | Japan | 164/437 |
| 4-41053 | 2/1992 | Japan | 164/432 |

OTHER PUBLICATIONS

Translation of Belgian Patent 864,035 published Jun. 16, 1978.

*Primary Examiner*—J. Reed Batten, Jr.

*Attorney, Agent, or Firm*—David V. Radack; Eckert Seamans Cherin & Mellott, LLC

[57] ABSTRACT

The apparatus includes a tundish, a nozzle for receiving molten metal from the tundish and discharging molten metal into a mold of a caster and a plurality of tubes interposed between the tundish and the nozzle for transporting the molten metal from the tundish to the nozzle. The apparatus further includes a plurality of wear strips having a first end portion secured to the tundish and a second end portion secured to the nozzle. The wear strips secure the nozzle to the tundish, provide a tight secure fit of the tubes to the nozzle and protect the nozzle from wearing.

19 Claims, 4 Drawing Sheets

APPARATUS FOR DELIVERING MOLTEN METAL TO A CASTER INCLUDING WEAR STRIPS

BACKGROUND OF THE INVENTION

This invention relates to an apparatus for delivering molten metal to a caster, and more particularly to a molten metal delivery apparatus including a tundish, a nozzle, a plurality of tubes disposed between the tundish and the nozzle, and a plurality of wear strips for securing the nozzle to the tundish. The wear strips provide a tight secure fit of the tubes to the nozzle and protect the nozzle from wearing.

Twin belt continuous casting machines, such as that disclosed in U.S. Pat. No. 4,964,456, include a tundish which receives molten metal from a furnace, the molten metal being subsequently fed to a nozzle. The molten metal flows through the nozzle and into the mold, which is formed by a pair of opposed belts and a pair of opposed side dams. The molten metal solidifies in the mold and emerges as a cast metal product which is subsequently moved out of the mold at casting speed.

U.S. Pat. No. 4,785,873 discloses sealing the belt against the nozzle by means of a rail supported by springs. Due to this sealing, the belt comes into frictional contact with the nozzle. The nozzle itself is made of a refractory material and thus can be damaged or broken early in its life by the constant wearing action of the belt thereagainst. For a more detailed description of a nozzle for a twin belt caster, see also U.S. Pat. No. 4,798,315, the disclosure of which is expressly incorporated herein by reference.

What is needed is a molten metal delivery apparatus that improves effectiveness and efficiency in transporting molten metal from the tundish to the nozzle for subsequent delivery into the mold formed by the movable belts of the caster.

SUMMARY OF THE INVENTION

The invention has met or exceeded the above mentioned needs as well as others. The molten metal delivery apparatus includes a tundish, a nozzle for receiving molten metal from the tundish and discharging molten metal into a mold of a caster and a plurality of tubes interposed between the tundish and the nozzle for transporting the molten metal from the tundish to the nozzle. The apparatus further includes a plurality of wear strips having a first end portion secured to the tundish and a second end portion secured to the nozzle. The wear strips secure the nozzle to the tundish, provide a tight secure fit of the tubes to the nozzle and protect the nozzle from wearing.

BRIEF DESCRIPTION OF THE DRAWINGS

A full understanding of the invention can be gained from the following description of the preferred embodiment when read in conjunction with the accompanying drawings in which.

DETAILED DESCRIPTION

As used herein, the term "metal product" means primarily clad or unclad strip or slab made substantially of one or more metals, including without limitation, aluminum and aluminum alloys and can also include, in a broader sense, clad or unclad bar, foil or rod.

The molten metal delivery apparatus of the invention is useful for transporting molten metal from a trough leading from a furnace into a mold of a caster for continuously casting the molten metal into a metal product. There are several known types of casters, including a belt caster, a roll caster, a block caster and a wheel caster. Furthermore, these casters can have a vertical or horizontal orientation. Although the detailed description is directed towards a generally vertically oriented twin belt caster, the invention is not limited to use with vertical twin belt casters but may also be used with other casters, whether vertically or horizontally oriented.

Figure 1:
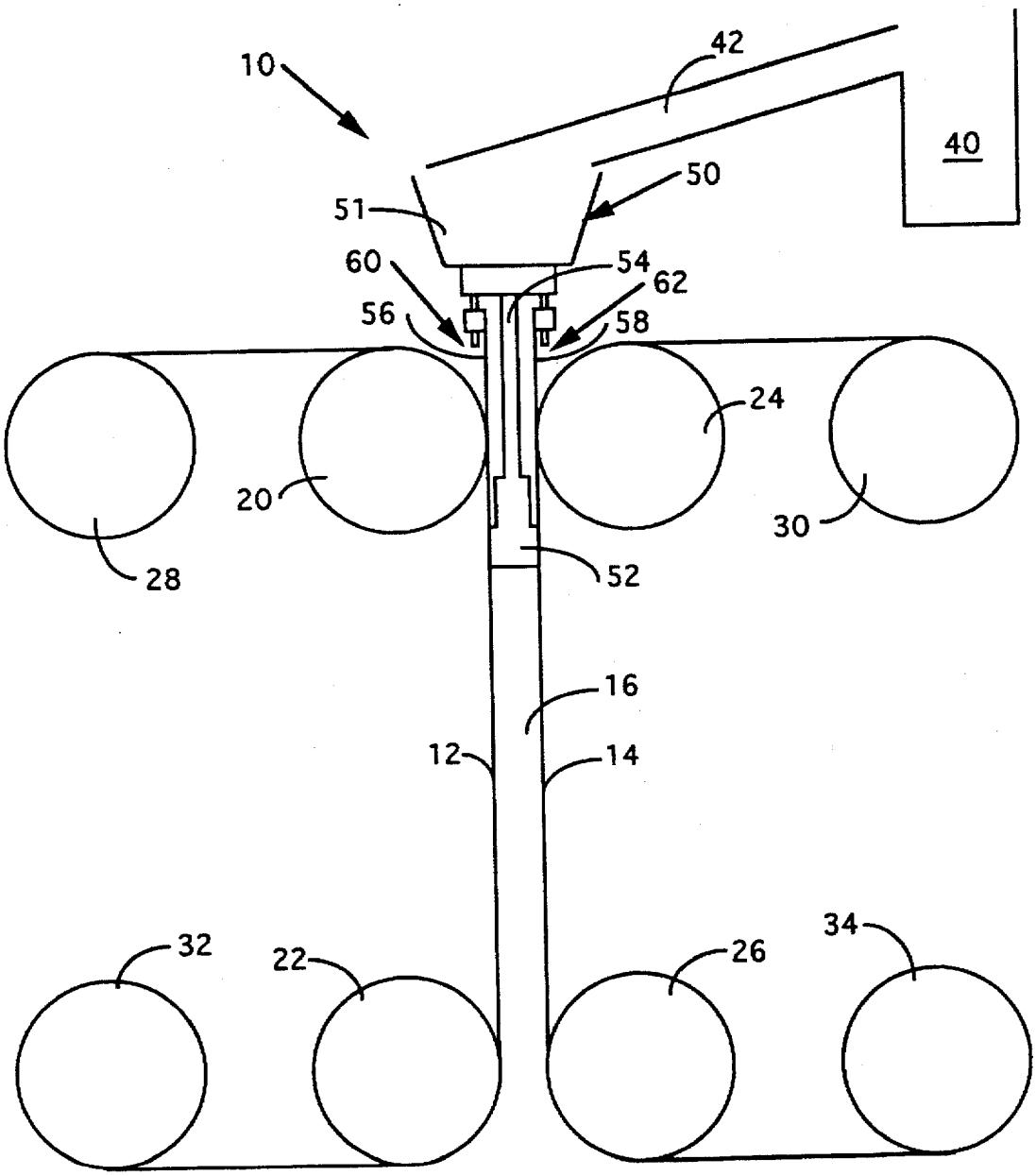
FIG. 1 is a partially schematic, side elevational view of a twin belt caster including the molten metal delivery apparatus of the invention.

FIG. 1 shows a vertical twin belt caster 10. The twin belt caster 10 consists of a pair of movable opposed belts 12 and 14 which together with a pair of opposed movable side dams (not shown) define a mold 16 in which molten metal is continuously cast into a metal product. The belts are each guided through the mold 16 by a set of pulleys such as pulleys 20, 22 for belt 12 and pulleys 24, 26 for belt 14. The belts 12 and 14 are uncoiled from respective upper coils 28, 30 and then wound onto respective lower coils 32, 34. For a more detailed description of a vertical twin belt caster, please refer to U.S. Pat. No. 4,964,456, the disclosure of which is incorporated by reference herein.

The molten metal to be cast in the mold 16 is taken from a furnace 40 and is transported by a trough 42 into the molten metal delivery apparatus 50 of the invention. The molten metal delivery apparatus 50 will be described in detail below, but generally consists of a tundish 51, nozzle 52 and a plurality of tubes, tube 54 being shown in FIG. 1. The tubes are interposed between the tundish 51 and the nozzle 52 for delivering the molten metal from the tundish 51 to the nozzle 52. The molten metal delivery apparatus 50 further consists of two sets of a plurality of wear strips. Each set is disposed on either side of the molten metal delivery apparatus 50. Each set includes a plurality of wear strips, such as wear strip 56 and wear strip 58. The function and structure of the wear strips will be discussed below with respect to FIGS. 2–5.

Figure 2:
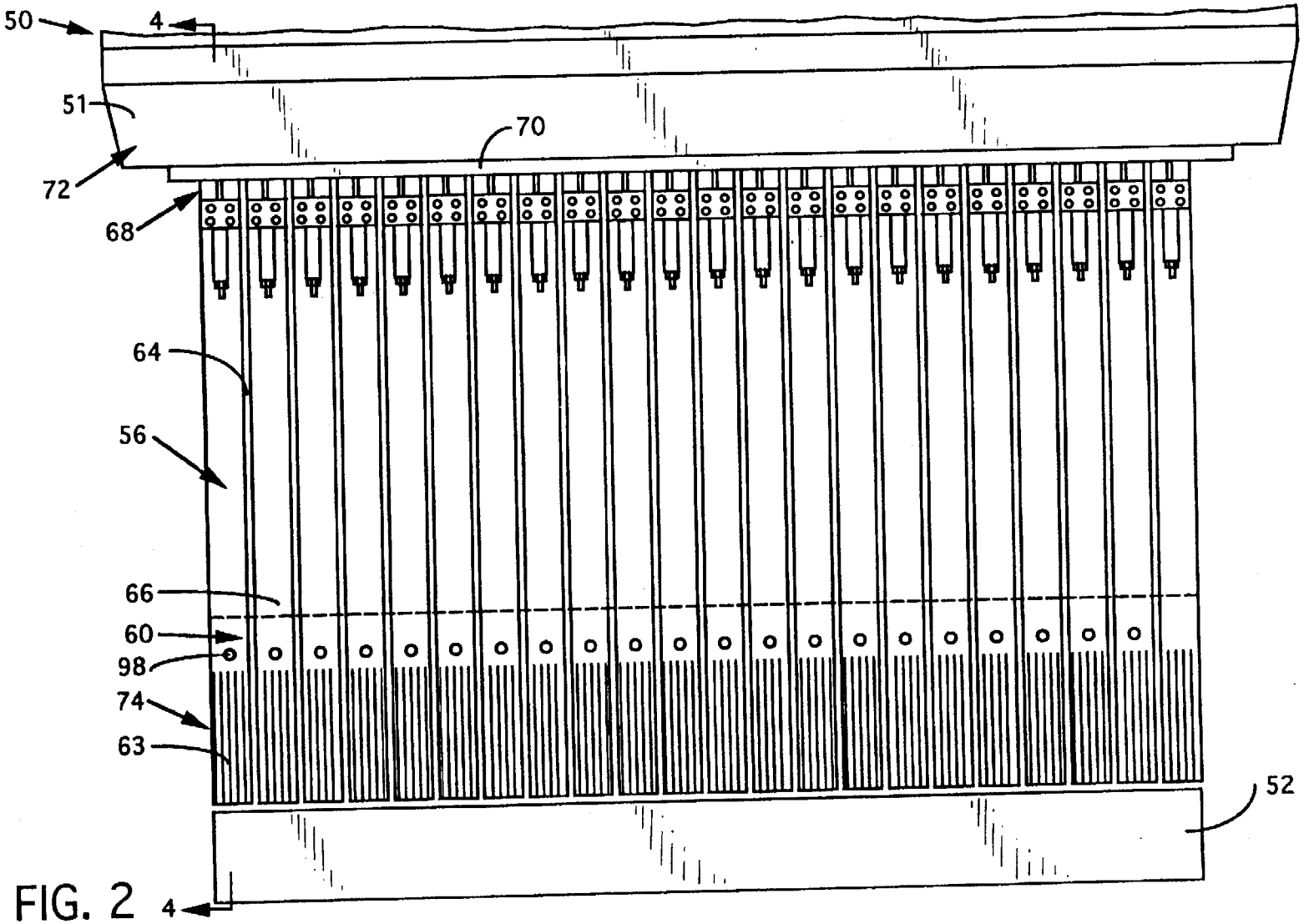
FIG. 2 is a front elevational view of the molten metal delivery apparatus of the invention.

Referring now to FIG. 2, the molten metal delivery apparatus 50 will be described in further detail. As can be seen, there are a plurality of wear strips (twenty-two are shown in FIG. 2) such as wear strip 56, shown in this first set 60 of wear strips. It will be appreciated that wear strip 58 is one of a plurality of wear strips in a second set of wear strips 62 on the opposite side of tube 54 from first set 60 of wear strips. The wear strips, such as wear strip 56, of the first set of wear strips 60 are generally aligned with the wear strips, such as wear strip 58, of the second set of wear strips 62. The wear strips in each set are disposed in an adjacent side-by-side arrangement. The wear strips are preferably made of stainless steel and include on the end portion nearest to the nozzle tungsten carbide inserts, such as inserts 63 on wear strip 56. Inserts 63 are shown as being vertically oriented, but can also be horizontally oriented if desired. Referring back to FIG. 1, these inserts 63 are positioned at the point where the belt 12 makes contact with the molten metal delivery apparatus 50. Thus, one function of the wear strips is to protect the upper portion of the nozzle 52 (shown in phantom line drawing in FIG. 2), which is made from a refractory material, from undue wear due to the friction of the belt 12 against the nozzle 52.

The wear strips are constructed and arranged so that each wear strip can thermally expand laterally when molten metal is being delivered through the tubes 54 to the mold 16. A gap, such as gap 64 between adjacent wear strips 56 and 66, is provided to accommodate this expansion. The gap 64 is somewhat exaggerated in FIG. 2, but preferably is about 0.2 mm. The wear strips themselves are preferably about 20 to 30 mm in width, about 40 cm to 80 cm in length and about 0.2 mm to 2.5 mm (preferably around 1 mm) in thickness. This size allows for proper thermal expansion, while at the same time functioning to support the nozzle 52 from the tundish 50 as will be explained below. The thickness of the wear strip as shown in FIGS. 3 and 4 is increased in order to more effectively illustrate the features of the invention.

The wear strips have a first end portion, such as first end portion 68 of wear strip 56, which is secured to a steel plate 70 which, steel plate 70 being itself fastened to the base 72 of the tundish 51. The wear strips also have a second end portion 74 which is secured to the nozzle 52. In this way the wear strips support the nozzle 52 from the tundish 51, and in turn tightly and securely fit the tubes, such as tube 54 shown in FIGS. 1 and 2, between the tundish 51 and the nozzle 52.

Figure 3:
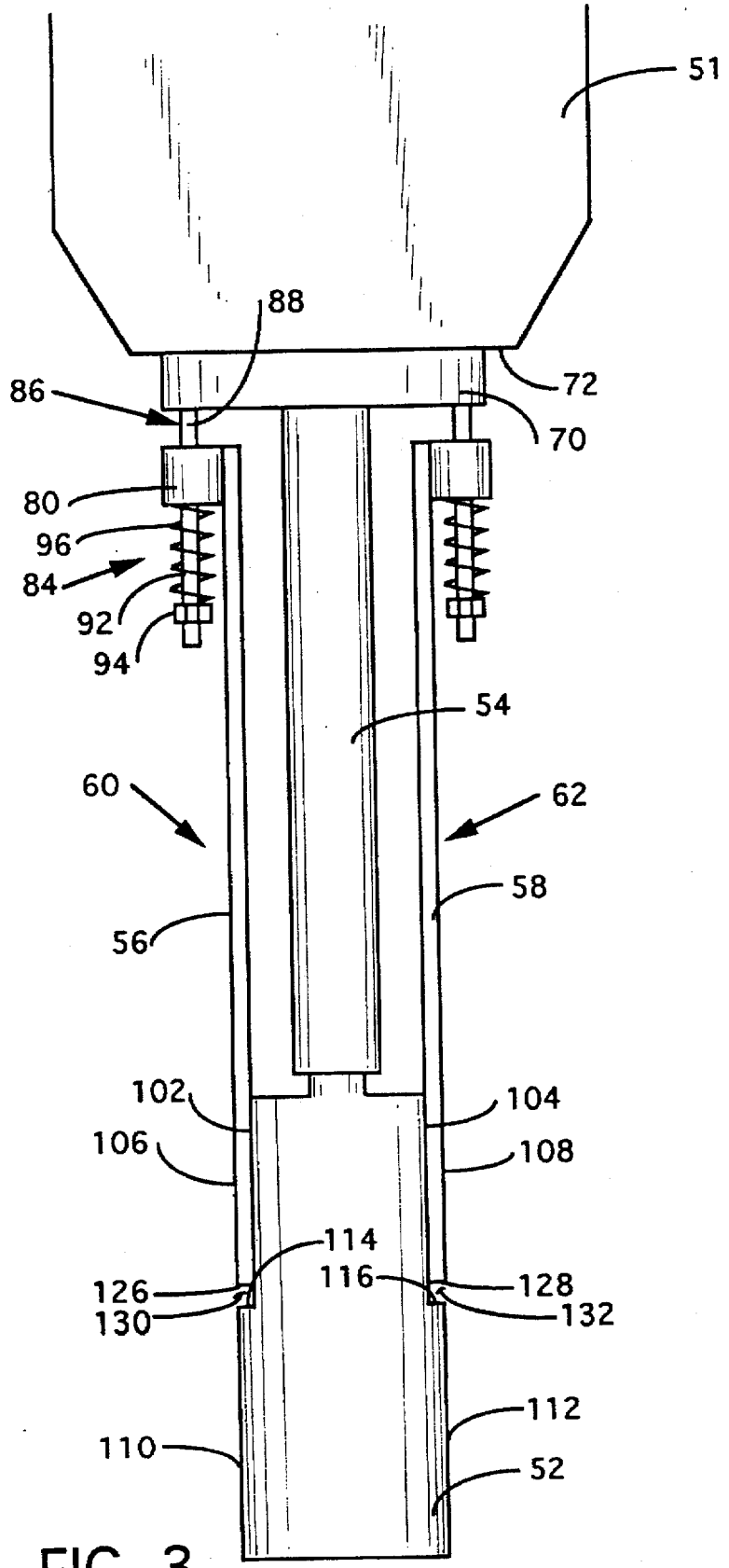
FIG. 3 is a side elevational view of the molten metal delivery apparatus of the invention.
Figure 4:
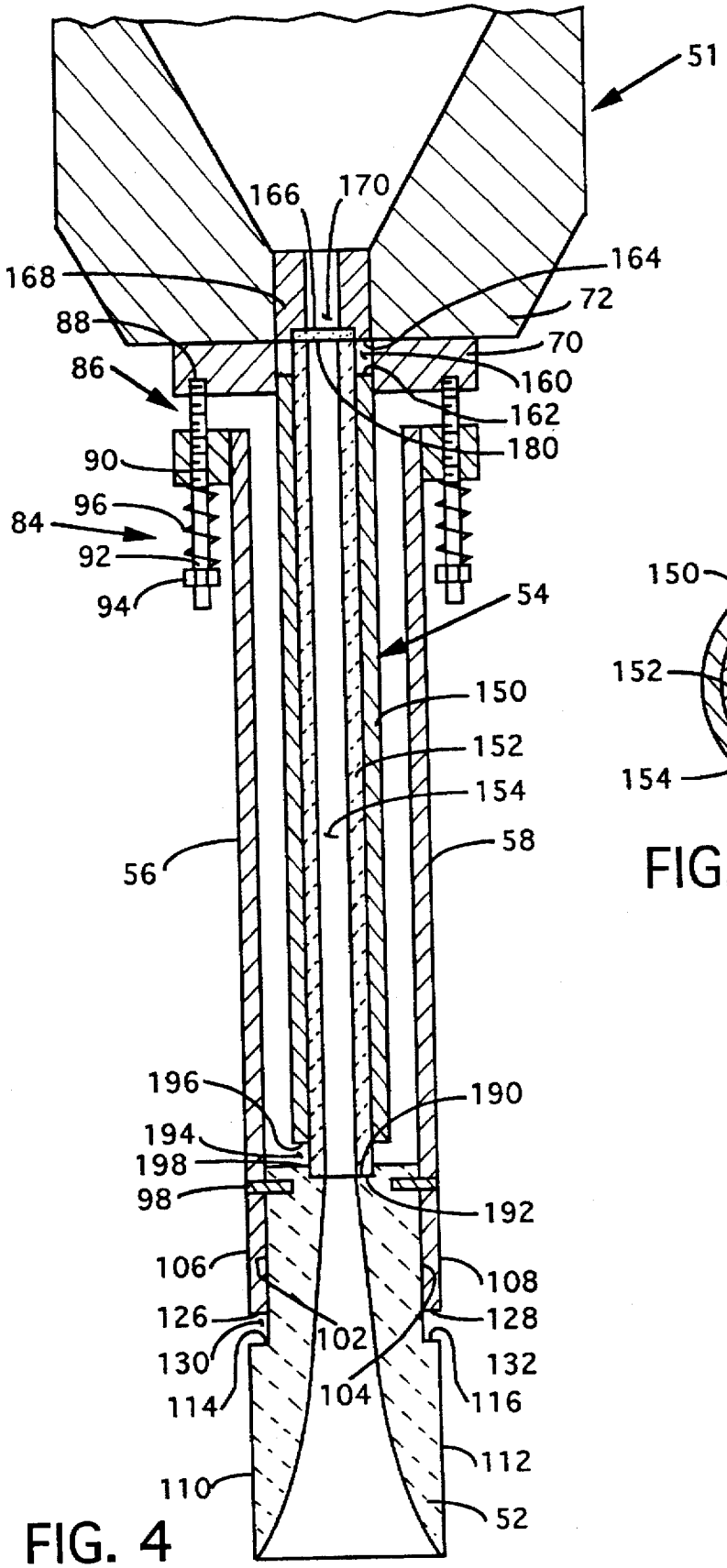
FIG. 4 is a cross-sectional view taken along line 4—4 of FIG. 2.

Referring now to FIGS. 3 and 4, it will be best seen how the wear strips are secured to the tundish 51 and the nozzle 52. As can be seen, wear strip 56 includes a metallic block 80 which is secured to the steel plate 70 of the base 72 of the tundish 50 by a spring biased fastener means 84. This spring biased fastener means 84 includes a bolt 86 having a first end portion 88 secured into the steel plate 70, an intermediate portion 90 (FIG. 4) which extends through the metallic block 80 and a second portion 92 including a nut 94 threaded thereon. A coil spring 96 is disposed between the nut 94 and the metallic block 80. The other end of the wear strip 56 is secured to the nozzle 54 by a pin 98 (FIG. 4). Thus, by adjusting the nut 94, and therefore the spring.96, the wear strip biases the nozzle 52 towards or away from the tundish 51. This in turn acts to securely fit the tubes, such as tube 54 shown in FIG. 3 between the tundish 51 and the nozzle 52, and thus resist leakage from the tubes.

As can be seen from FIG. 3, the wear strips are disposed on either side of the molten metal delivery apparatus 50 in order to protect the upper outer surfaces 102, 104, of the nozzle 52 from wearing by belts 12 and 14. This arrangement also insures a tight secure fit of the tubes between the nozzle 52 and the tundish 51.

Referring to both FIGS. 2 and 3, but especially FIG. 3, it will be seen that the outer surface of the wear strips 106 and 108 are co-planar with the lower outer surfaces 110, 112 of the nozzle 52. The wear strips also include a free edge 126, 128 which is spaced from edge surfaces 114 and 116 of the nozzle 52 to form gaps 130, 132 therebetween (see also FIG. 2). The gaps 130, 132 can be from 1 mm to 4 mm, with 2 mm to 3 mm being preferred. These gaps 130, 132 provide an area into which the wear strips can thermally expand longitudinally when molten metal is being delivered from the tundish 51 to the nozzle 52 through the tubes 54. Thus gaps 130, 132, along with the gaps between adjacent wear strips, such as gap 64 (FIG. 2) allow the wear strips to thermally expand both laterally and longitudinally when molten metal is contained in the molten metal delivery apparatus.

Figure 5:
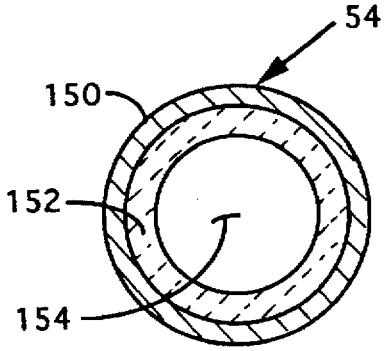
FIG. 5 is a horizontal cross-sectional view of the tube which transports molten metal from the tundish to the nozzle.

Referring to FIGS. 4 and 5, the interaction of the wear strips, the nozzle 52, the tubes 54 and the tundish 51 will be explained. The tubes, such as tube 54, are preferably circular in cross-section as shown best in FIG. 5, having an outer tube 150, made of steel, surrounding an inner tube 152 made of a refractory material. The inner tube defines a passageway 154 for the molten metal to pass through the tube 54. The inner tube 152 is frictionally supported by the outer tube 150, however, outer tube 150 can expand longitudinally with respect to inner tube 152, as will be explained below. In order for the steel outer tube 150 to avoid contacting molten metal and in order for the steel outer tube 150 to be allowed to expand when molten metal is being carried in the inner tube 152, the steel outer tube 150 is shorter in length than the inner tube 152 as can best be seen in FIG. 4. Thus an upper gap 160 is formed between the top edge 162 of the steel outer tube 150 and the bottom edge 164 of the opening 166 in the distribution block 168 disposed in the tundish 51 (for a more detailed description of the distribution block 168 and tundish 51, see U.S. Pat. No. 4,798,315). The upper gap 160 is shown somewhat exaggerated in FIG. 4 in order to more clearly show this feature of the invention. Gap 160 can be about 2mm to 6 mm with about 3mm to 5mm being preferred.

In order to further insure a tight compressive seal between the passageway 170 in the distribution block 168 and the passageway 154 formed in the inner tube 152, a seal 180, preferably made of ceramic paper, is disposed therebetween. It will be appreciated that the seal 180 does not extend into the gap 160 in order to permit the steel outer tube 150 to expand therein.

On the opposite end of the tube, the bottom edge 190 of the inner tube 152 is in intimate surface-to-surface contact with a horizontal edge 192 formed in the nozzle 52. This will insure a tight fit between the inner tube 152 and the nozzle 52. A gap 194 is also formed between the bottom edge 196 of the outer steel tube 150 and the top edge 198 of the nozzle 52. FIG. 4 also shows this gap 194 somewhat exaggerated in order to more clearly show this feature of the invention. This gap 194 can be about 2mm to 6 mm, preferably around 3mm to 5 mm. As with gap 160, this gap 194 allows the steel outer tube 150 to thermally expand when molten metal is disposed in the inner tube 152. As was explained above, the inner tube 152 is held in place relative to the outer tube 150 by a friction fit, but not so forceful as to prohibit movement of the outer tube 150 relative to the inner tube 152 by thermal expansion of the outer tube 150. Thus, the inner tube 152 can be positioned to form any size upper gap 160 or lower gap 194.

It will be appreciated that a molten metal delivery apparatus has been provided which includes steel wear strips for securing a nozzle to a tundish, and permitting flow of molten metal from the tundish to the nozzle by a plurality of tubes. The steel wear strips, in addition to securing the nozzle to the tundish, also provide a tight secure fit of the tubes to the nozzle and furthermore, provide a protective covering for the nozzle from the frictional force of the belts of the caster against the surface of the nozzle.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A molten metal delivery apparatus for introducing molten metal into a mold of a caster, said molten metal delivery apparatus comprising:

a tundish;

a nozzle for receiving molten metal from said tundish and discharging said molten metal into said mold;

a plurality of tubes interposed between said tundish and said nozzle for transporting said molten metal from said tundish to said nozzle; and a plurality of wear strips having a first end portion secured to said tundish and a second end portion secured to said nozzle, said wear strips (i) securing said nozzle to said tundish; (ii) providing a tight secure fit of said tubes to said nozzle and (iii) protecting said nozzle from wearing.

2. The apparatus of claim 1, wherein each of said wear strips includes means for biasing said nozzle towards said tundish so that said tubes are securely interposed between said tundish and said nozzle.

3. The apparatus of claim 2, wherein said biasing means includes a metal block attached to said wear strip, said metal block being secured to said tundish by a spring loaded fastener.

4. The apparatus of claim 2, wherein each of said tubes consists of an outer tube and inner tube surrounded by said outer tube, said inner tube defining a passageway for the passage of said molten metal through said tube.

5. The apparatus of claim 4, wherein said outer tube is made of metal and is shorter in length than said inner tube and said inner tube is compressively fit between said tundish and said nozzle whereas said outer tube is free to expand in length when molten metal passes through said tubes.

6. The apparatus of claim 5, wherein said nozzle has a recessed area for receiving said inner tube so that said inner tube is compressively fit between said nozzle and said tundish whereas said outer tube is free to expand when molten metal passes through said tube.

7. The apparatus of claim 6, including a seal disposed between said tundish and said inner tube to resist leakage of molten metal from said tube.

8. The apparatus of claim 1, wherein each said wear strip has tungsten carbide inserts to provide a wearing surface for said wear strip.

9. The apparatus of claim 1, wherein said wear strips are arranged such that a gap is maintained between adjacent said wear strips so that said wear strips are free to expand laterally when molten metal flows through said tubes.

10. The apparatus of claim 9, wherein said gap is about 0.2 mm.

11. The apparatus of claim 1, wherein said nozzle has an outer surface including a first outer surface and a second outer surface, said first outer surface being recessed with respect to said first outer surface, said first outer surface being divided from said second outer surface by an edge surface which is generally perpendicular to both said first outer surface and said second outer surface, said edge surface and said second outer surface defining a recessed area.

12. The apparatus of claim 11, wherein said outer surface of said wear strip is generally co-planar with said second outer surface of said nozzle.

13. The apparatus of claim 11, wherein said second end portions of each said wear strip each includes a free edge portion; and said wear strips are arranged such that a gap is created between said edge surface of said nozzle and said free edge portions of said second end portions of said wear strips to allow for longitudinal expansion of said wear strips when molten metal flows through said tubes.

14. The apparatus of claim 1, wherein said wear strip is secured to said nozzle by a pin.

15. The apparatus of claim 1, including a first set of wear strips disposed on one side of said apparatus and a second set of wear strips disposed on the opposite side of said apparatus.

16. The apparatus of claim 15, wherein said wear strips of said first set and said wear strips of said second set are generally aligned.

17. The apparatus of claim 1, wherein said nozzle is made of a refractory material.

18. The apparatus of claim 1, wherein said caster is a twin belt caster including a pair of opposed movable belts and a pair of opposed side dams which together form said mold.

19. The apparatus of claim 18, wherein said twin belt caster is a generally vertically oriented twin belt caster.

* * * * *